United States Patent [19]

Goldberg

[11] Patent Number: 5,038,503

[45] Date of Patent: Aug. 13, 1991

[54] PHOTOGRAPH ASSEMBLY ARRANGEMENT

[76] Inventor: Hyman Goldberg, c/o Mrs. M. Bachmayer, 3 Ovens Place, St. Ives Chase, NSW 2075, Australia

[21] Appl. No.: 590,044

[22] Filed: Sep. 27, 1990

Related U.S. Application Data

[63] Continuation of Ser. No. 156,295, Feb. 16, 1988, abandoned.

[30] Foreign Application Priority Data

Feb. 26, 1987 [AU] Australia ..... PI0561

[51] Int. Cl.[5] ..... A47G 1/06

[52] U.S. Cl. ..... 40/156; 40/158.1; 428/40; 206/44 B

[58] Field of Search ..... 428/40, 906, 343, 137; 206/44; 40/156, 158.1, 154

[56] References Cited

U.S. PATENT DOCUMENTS 3,032,181 5/1962 Hutter et al. ..... 206/411

4,792,473 12/1988 Vitale ..... 428/40

*Primary Examiner*—Richard J. Apley

*Assistant Examiner*—D. F. Crosby

*Attorney, Agent, or Firm*—Alfred Stapler

[57] ABSTRACT

A container for photographs includes a container housing having walls defining a chamber, and a separating member subdividing the chamber into a main chamber for receiving a number of photographs and a sub-chamber for receiving negative strips for photographs. The photographs include a number of photograph prints arranged in edge-to-edge relationship, and a number of adhesive strips, one of each respectively being attached to the neighboring edges of such photograph prints to join the photograph prints into an elongated chain form.

3 Claims, 4 Drawing Sheets

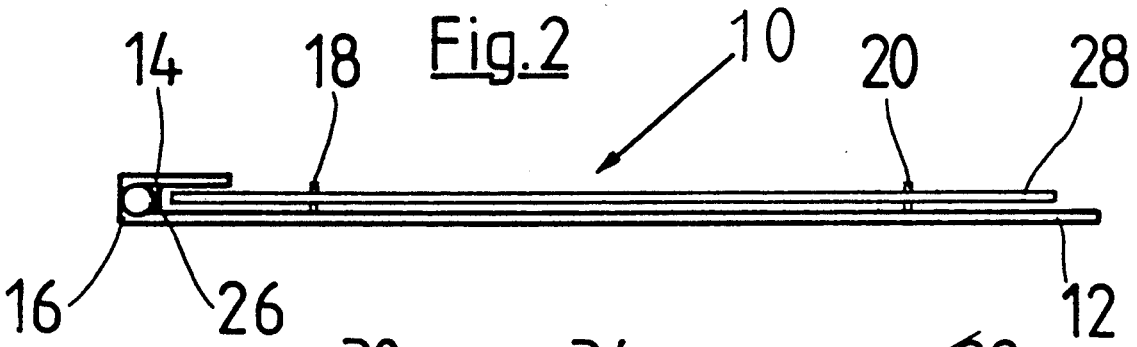
Fig.2
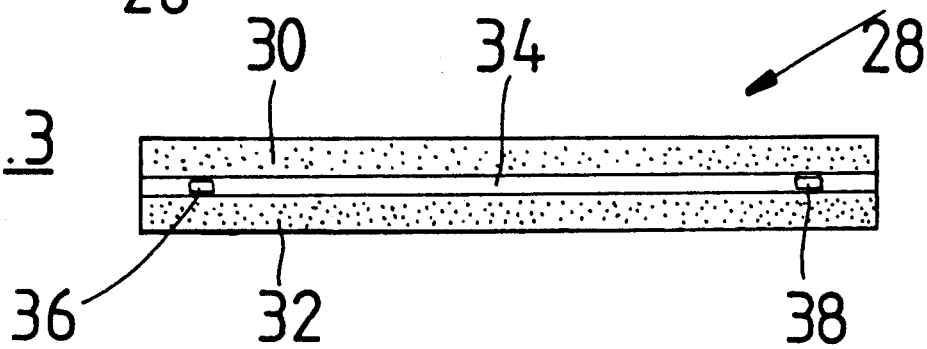
Fig.3
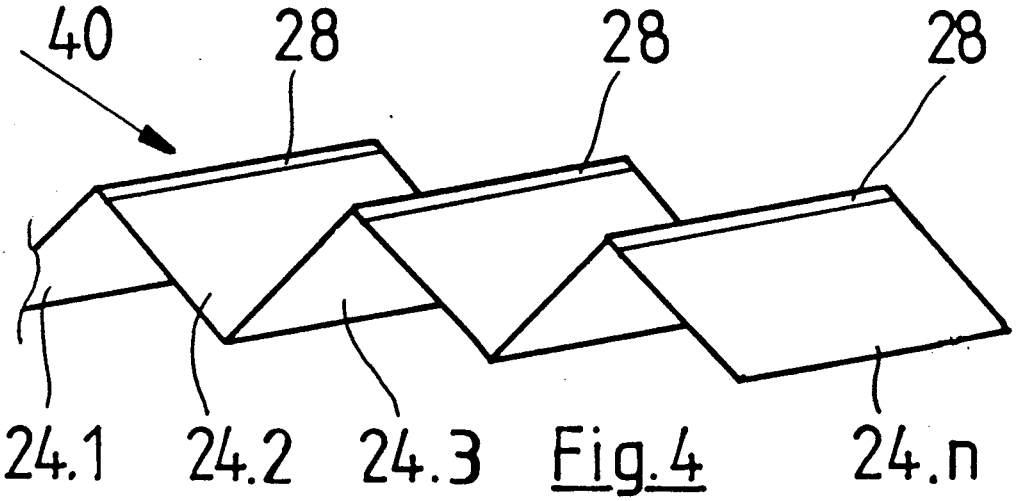
Fig.4
Fig.5
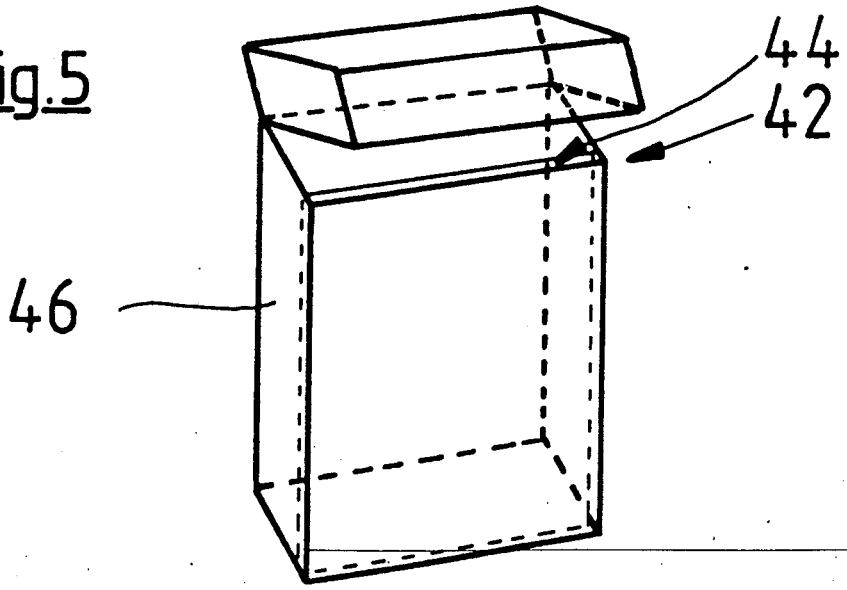

PHOTOGRAPH ASSEMBLY ARRANGEMENT

This application is a continuation of application Ser. No. 07/156,295 filed Feb. 16, 1988, now abandoned.

FIELD OF INVENTION

The present invention relates to photograph assembly arrangements.

More particularly, the invention relates to a photograph assembly arrangement involving a system for mounting and storing photoprints.

BACKGROUND TO INVENTION

A problem encountered by many photographers or "snapshotters" is the storage of the photograph prints obtained from a processed roll of film and as received from the photoprocessors. Traditionally, the prints have been mounted in albums of different size, shape and design. The main disadvantage of such albums is their bulk and inability, once mounted, to carry an individual set of prints around on the person or in a purse or other small container.

In order to overcome this problem small albums have been devised for mounting individual sets of prints, normally in clear plastic film leaves defining pockets for receiving such prints. However, such albums, although portable, are still relatively bulky and no provision is made in such albums for the simultaneous storage of the negatives, which are usually returned by the processor cut into strips of four negatives each from the original twenty four or thirty six exposure 35 mm film.

Furthermore, it is difficult to store such individual albums in a neat standardized form with the contents clearly visible on visual inspection only.

Other forms of storage exist, such as a double layer of clean plastic film folded in zigzag fashion, a pair of prints being inserted back to back in each fold. This system too has the same disadvantages of being bulky and difficult to index for filing. There is also the disadvantage of the image on a print being dulled by the plastic covering when viewing through the plastic film.

It is an object of the invention to suggest a photograph assembly arrangement which will assist in overcoming the aforementioned problems.

SUMMARY OF THE INVENTION

According to the invention, a container for photographs includes a container housing having walls defining a chamber, and a separating member subdividing the chamber into a main chamber for receiving a number of photographs and a sub-chamber for receiving negative strips for photographs.

The container housing may be of square box shape.

The separating member may be a strip sheet, which is withdrawable from the chamber.

The strip sheet may have a flap, which is insertable into a cut-out in one wall of the container housing.

Further according to the invention, a photograph mounting device includes a board panel on which at least two photograph prints can be placed in edge to edge relationship; at least one locating element provided on the board panel, and being adapted to be located against the adjoining edges of two photograph prints to be mounted; and a side guide adapted to guide the side edges of photograph prints to be mounted.

The locating element may be in the form of a ridge, or pins, e.g. two spaced apart pins.

The device may include releasable holding means, such as a spring biased flap, for keeping photograph prints to be mounted together in position on the board panel whilst applying a joining member to the photograph units.

At least one locating hole may be provided in the joining adhesive strip and be adapted to be located between two neighbouring edges of the photograph prints.

Further according to the invention, a photograph assembly arrangement includes a number of photograph prints arranged in edge-to-edge relationship, and a number of joining adhesive strips, one of each respectively being attached to the neighbouring edges of such photograph prints to join the photograph prints into an elongated chain form.

Yet further according to the invention, a joining member for joining photographs includes a strip of sheet material, two adhesive areas provided spaced apart on the strip of sheet material, and a non-adhesive area between the two adhesive areas, each of the adhesive areas being respectively adapted to be adhesively joined to an edge of a photograph print with the non-adhesive area located between two such joined photograph prints.

Each adhesive area may be in the form of a longitudinal continuous section.

Each adhesive area may contain self-adhesive material, and, prior to use, may be covered by a tear-off backing sheet.

BRIEF DESCRIPTION OF DRAWINGS

The invention will now be described by way of example with reference to the accompanying schematic drawings.

In the drawings there is shown in

FIG. 2 an end view seen along arrow II in FIG. 1;

FIG. 3 a plan view of a joining adhesive strip in accordance with the invention;

FIG. 4 on a smaller scale a pictorial view of photograph prints assembled together in chain form in accordance with the invention;

FIG. 5 a pictorial view of a first embodiment of a container for containing a chain of photograph prints assembled together as well as the associated negatives;

DETAILED DESCRIPTION OF DRAWINGS

Figure 1:
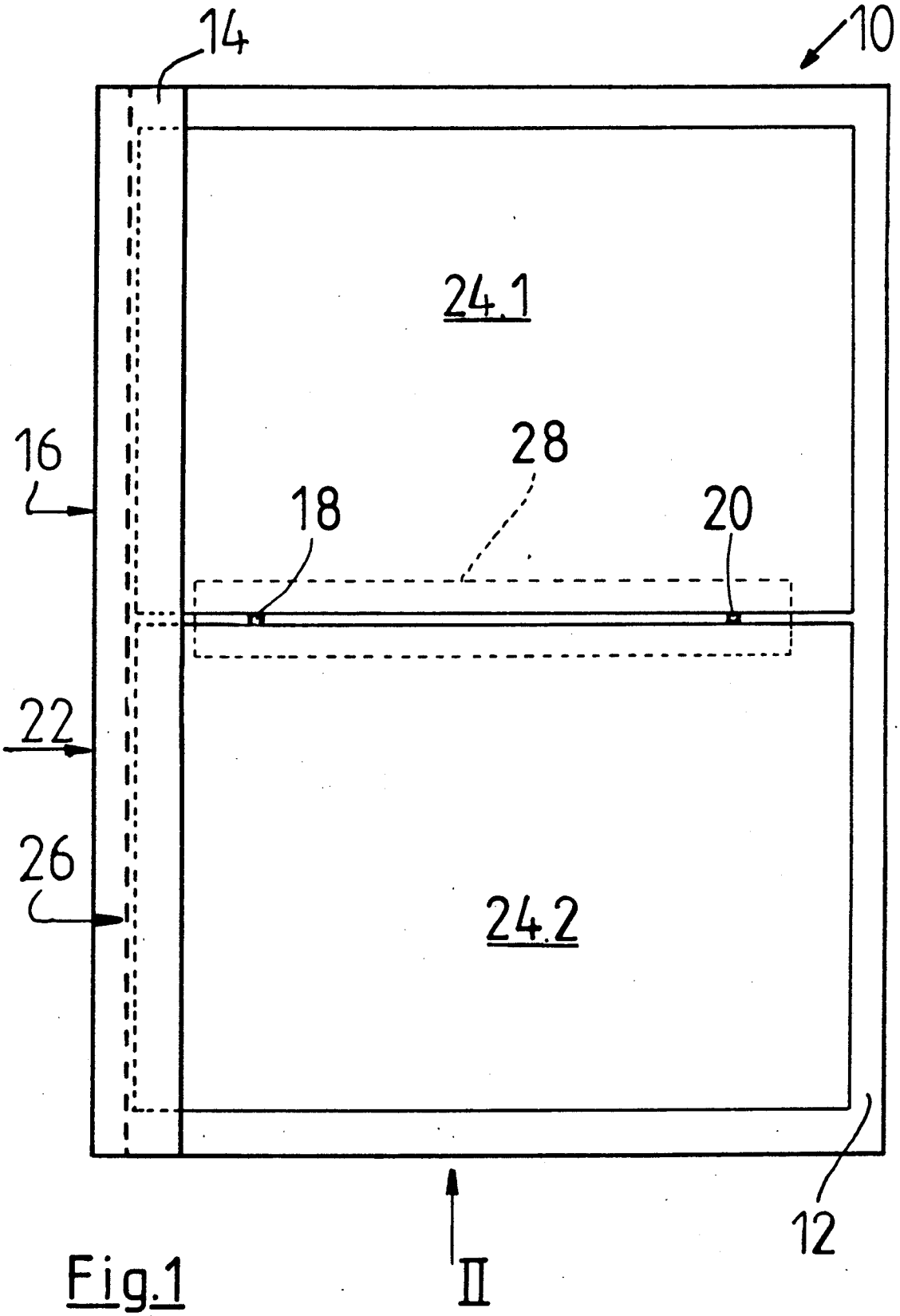
FIG. 1 a plan view of a first embodiment of a mounting board for photograph prints in accordance with the invention.

Referring to FIGS. 1 and 2, the board device, for assembling or mounting photograph prints in accordance with the invention, is generally indicated by reference numeral 10. It includes a flat panel 12 with a pressure pad or biased flap 14 along one edge 16 of the panel 12.

Centrally two locating pins 18 and 20 are provided on the panel 12.

The flap 14 is hinged by means of a hinge 22 to the panel 12. The flap 14 may extend along the full edge 16 or be of shorter length being located centrally of the panel 12.

Two photograph prints 24.1 and 24.2 are shown to be located against a locating ridge 26 adjacent the edge 16 and the pins 18 and 20. This ridge 26 can be of any suitable form, e.g. elongated or provided as short sections or in the form of spaced apart pins or knobs or be the boundary edge of the edge 16.

The pins 18, 20 ensure that the print 24.1 is parallel relative to its neighbouring print 24.2 and to ensure that a gap of standard width is defined between two neighbouring prints 24.1, 24.2.

The ridge 26 acts as a side stop so that at least one vertical edge of each print 24.1, 24.2 will be in a straight line with the other prints in the chain to be formed (see FIG. 4 i.e. chain 40).

The linking or joining strip 28 includes a strip of material on which adhesive areas are provided covered by a tear-off backing sheet. The adhesive areas are provided as two adhesive zones 30 and 32 separated by a non-adhesive zone 34. The strip 28 can be provided cut into standard predetermined lengths or as a continuous roll from which appropriate sections are cut off.

On the non-adhesive side of the strip 28, which is conveniently made of paper, though other material such as plastics foil or linen could be used, there may be printed suitable headings for recordal of details regarding the associated print, such as number, date, location, subject, etc.

Each standard length of strip 28 has two or more small slots or diameter holes 36, 38 (the holes preferably being between 1.5 mm and 2.5 mm in diameter or the slots having a width of about 1 mm and a length of about 4 to 5 mm) punched at standard points along the midline horizontally lengthwise of the strip 28. These holes 36, 38 correspond to the centres between the pins 18, 20 (or spines) on the panel 12.

The non-adhesive zone 34 preferably has a width of about 0.5 to 1.8 mm.

The zone 34 may also be perforated lengthwise to enable any print to be separated from the chain 40 without having to detach the contact adhesive strip 28.

As is shown in FIG. 4 a chain 40 of prints 24.1, 24.2 . . . **24.*n* is constructed, the individual neighbouring prints being joined by the strips 28**.

One embodiment of suitable carton container 42 is illustrated in FIG. 5. It is conveniently made of cardboard by folding and glueing, or of plastics material by moulding or forming. It is dimensioned so as comfortably to hold the number of prints, mounted, derived from a full film, usually 24 or 36. In practice it will be found to be more convenient to have only one size of carton for all prints up to 100 mm×150 mm, which results in a carton 42 having a thickness of about 12 to 20 mm, a depth of about 105 mm and a height of about 160 to 180 mm, the extra height being required to accommodate the negatives, which being cut into strips of four have a length per strip of 150 mm, which necessitates a filing envelope 44 of at least 160 mm long, and 100 mm wide to accommodate comfortably two negative strips side by side.

The negatives therefore may be stored, in one or two rows side by side, in the flat envelope 44 made of plastic film or of paper, whose breadth is such as to neatly fit into the carton 42, and not to be disturbed when the mounted set of prints are inserted or withdrawn from the carton 42. Alternatively the carton 42 may have a separate fixed division 44 built into it to accommodate the negatives.

For operation the following procedure is followed:

From the required set of prints to be mounted, one print 24.1 is placed above the horizontal mounting pins 18, 20 and the next print 24.2 is placed below the pins 18, 20. The prints 24.1, 24.2 are held in place by the soft clamp 14 on the vertical edge 16 of the panel 12 and vertical register is achieved by the vertical raised edge 26 below the soft clamp 14.

The adhesive strip 28 is stripped from its backing, and placed over the adjoining edges of the already positioned prints 24.1, 24.2. The holes 36, 38 on the midline of the adhesive strip 28 are placed over the pins 18, 20 which separate the two prints 22, 24. Then it is pressed into final place. Thereby the two prints 24.1, 24.2 are joined together in a satisfactorily alligned strip.

This process is repeated, moving the last joined print 24.2 vertically up (or down as preferred) one space at a time and then the next print to be mounted is placed into the located space of the previous print 24.1. The whole process is repeated until the whole series of prints are joined together so as to form a chain 40.

By folding at each print joined, commencing at one end successively face up then face down, that is "zigzag" fashion, the chain 40 is folded into a compact stack, which is accurately in register on at least three edges. The fourth edge will be in register according to the accuracy of cut of the original prints as supplied by the producer of the prints.

Because the exposed edge of the adhesive strip 28 between each pair of prints is free of adhesive, i.e. due to the zone 34, no tackiness exists at these positions.

Either at the time of mounting or subsequently, the user may fill in the descriptive details as he requires on the non-adhesive side of the joining strip 28, using preprinted lines as a guide. Alternatively, these details may be filled in before the strip is removed from its backing.

At this stage, the descriptive details also may be entered into the spaces provided on the flat sides of the storage carton 42. The spine 46 of the storage carton 42, also may be appropriately laid out so that the main details of date film number and location can be filled in there. As mentioned above a separate compartment, fixed in place, or in the form of removably fitted separator 44, is provided inside the carton 42 for the storage of the negatives for the prints 24.1 . . . **24.*n***.

The carton 42 itself then is stored, in booklike fashion on appropriate shelf, so that the spine detailing contents is easily visible.

Figure 6:
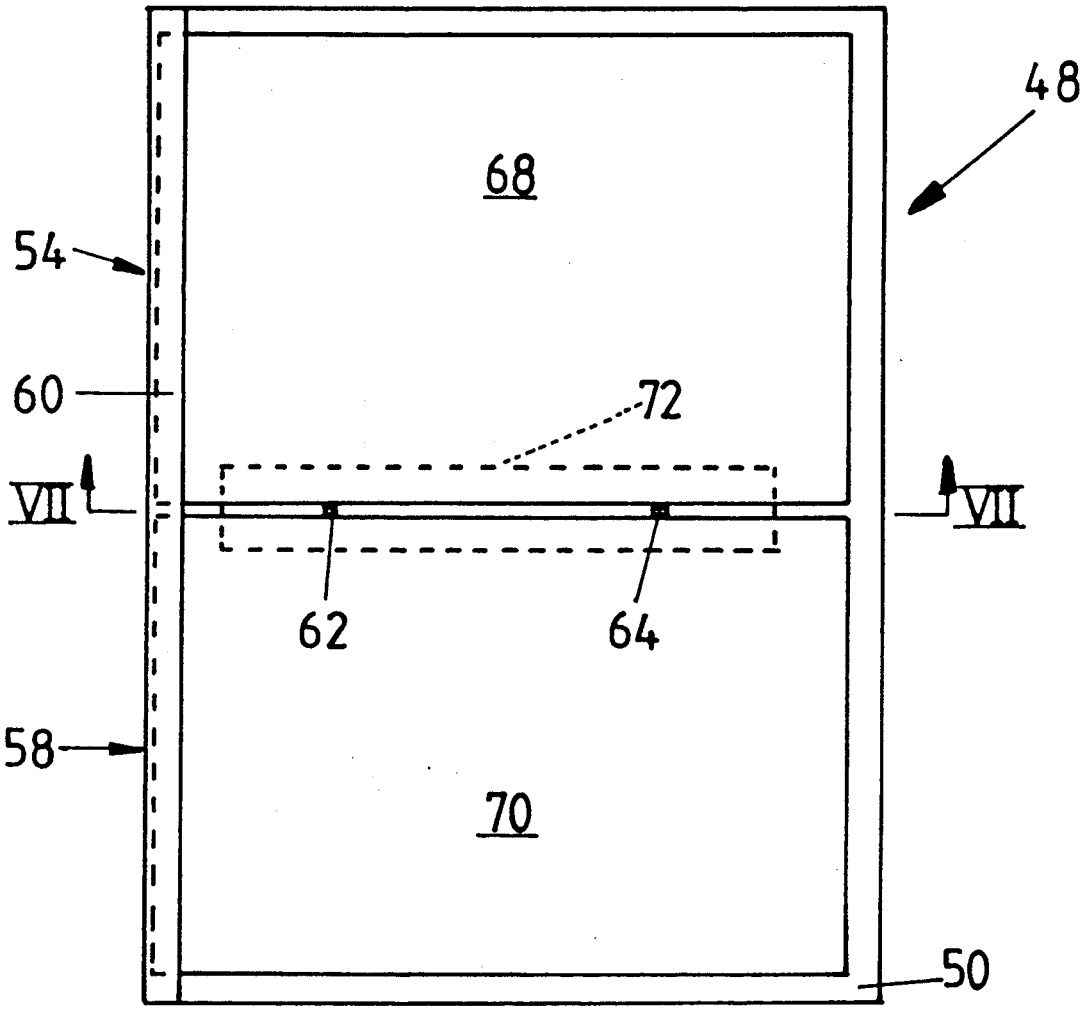
FIG. 6 a plan view of a second embodiment of a mounting board in accordance with the invention.
Figure 7:
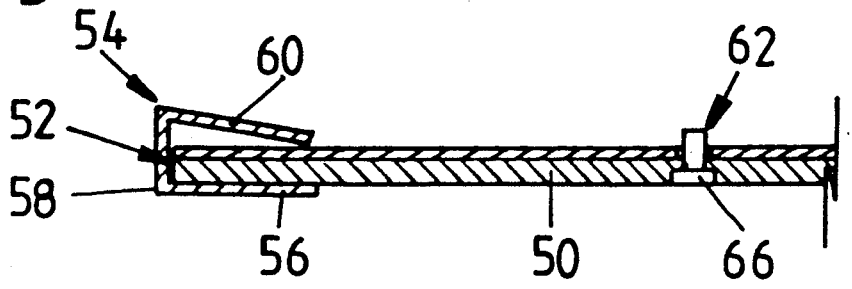
FIG. 7 on a larger scale, a sectional end view of the one side of the mounting board as seen along arrows VII—VII in FIG. 6.

Referring to FIGS. 6 and 7 the board 48 includes a flat panel 50 provided at one edge 52 with a locating channel 54. The locating channel 54 has a bottom strip 56 attached to the panel 50, a vertical edge strip 58 and an upper inclined biased strip 60.

Centrally the panel 50 carries two identical locating pins 62, 64. As shown in FIG. 7, the pin 62 has a base 66 located in the panel 50, e.g. embedded therein. The pins 62, 64 in plan view are of elongated shape.

The photographs 68, 70, which are to be mounted, are placed against the pins 62, 64 on opposite sides thereof and are inserted below the strip 60 until their edges abut against the edge strip 58. Thereafter the adhesive strip 72, which is identical to the strip 28 referred to in FIG. 1, is applied in similar manner as described with reference to FIG. 1.

Figure 8:
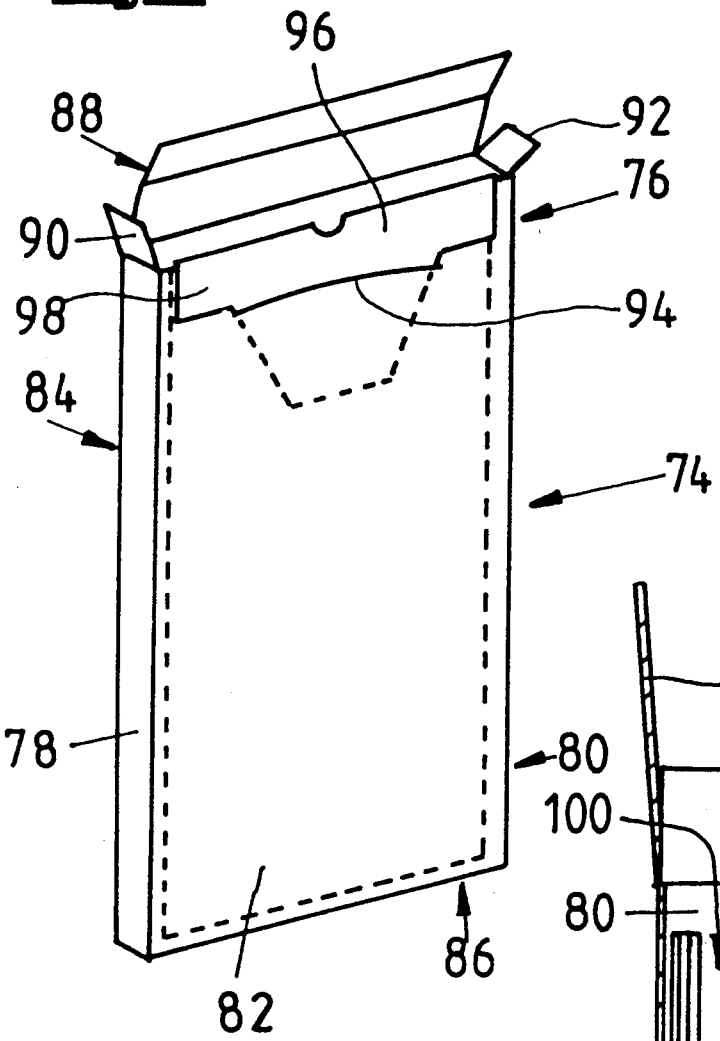
FIG. 8 a pictorial view of a second embodiment of a container for photographs in accordance with the invention.
Figure 9:
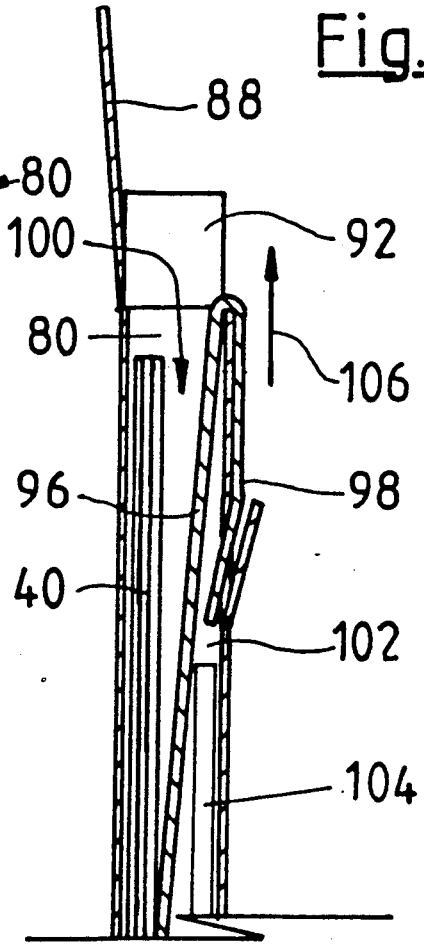
FIG. 9 on a larger scale, a sectional end view of the upper part of the container illustrated in FIG. 8.

Referring to FIGS. 8 and 9 the container 74 has a box-shaped housing 76 with vertical sides 78, 80, front and rear vertical sides 82, 84, a bottom side 86, a closable flap lid 88 and small side flaps 90, 92. The front side 82 has a cut-out 94.

The separating strip 96 has a flap 98 is insertable into the box 76 and the flap 98 is inserted into the cut-out 94 to be fitted in frictional fit thereto. In this position the strip 96 subdivides the inside of the box 76 into a main chamber 100, which is adapted to receive photographs, e.g. as joined together as shown in FIG. 4, and a subsidiary chamber 102, which is adapted to receive the negative strips of such photographs as indicated by reference numeral 104. The strip 96 can be pulled out in the direction indicated by arrow 106.

On the vertical front and rear sides 82, 84 of the box 76 any relevant information pertaining to the photographs may be recorded.

The box 76 may be made of any suitable material, e.g. cardboard or paper board.

I claim:

1. A plurality of joining members joining in edge-to-edge relationship photograph prints obtained from a processed roll of film, each of which includes a strip of sheet material, two adhesive areas provided spaced apart on the strip of sheet material and a non-adhesive area between the two adhesive areas, each of the adhesive areas being adapted to be adhesively joined to an edge of a different one of said photograph prints with the non-adhesive area located between two such joined photograph prints, each of said strips being cut to a length not greater than the adjoining edges of the photograph prints.

2. A plurality of joining members as claimed in claim 1, in which each adhesive area is in the form of a longitudinal continuous section.

3. A plurality of joining members as claimed in claim 1, in which at least one location hole is provided in the joining adhesive strip and being adapted to be located between two neighbouring edges of the photograph prints joined by the strip of sheet material.

* * * * *